United States Patent [19]

Zapletal et al.

[11] Patent Number: 4,771,494

[45] Date of Patent: Sep. 20, 1988

[54] OFFSET CONTINUOUS ROW COIL SPRING ASSEMBLY

[75] Inventors: Henry Zapletal, Carthage, Mo.; Edwin B. Watts, Muncie, Ind.; Terry L. Aronson, Pell Lake, Wis.; Thomas J. Wells, Carthage, Mo.

[73] Assignee: Leggett & Platt, Incorporated, Carthage, Mo.

[21] Appl. No.: 9,796

[22] Filed: Feb. 2, 1987

Related U.S. Application Data

[63] Continuation of Ser. No. 779,869, Sep. 25, 1985, abandoned.

[51] Int. Cl.[4] ..... A47C 23/04; F16F 3/04

[52] U.S. Cl. ..... 5/475; 5/248; 5/269; 267/91

[58] Field of Search ..... 5/248, 255, 256, 269, 5/475; 267/91-106

[56] References Cited

U.S. PATENT DOCUMENTS

| | | | |
|---|---|---|---|
| 3,648,737 | 3/1972 | Dull . | |
| 3,657,749 | 4/1972 | Norman . | |
| 3,911,511 | 10/1975 | Higgins et al. . | |
| 4,067,076 | 1/1978 | Krier | 5/269 |
| 4,112,726 | 9/1978 | Adams et al. . | |
| 4,358,097 | 11/1982 | Zapletal et al. . | |
| 4,488,712 | 1/1984 | Higgins | 5/475 |
| 4,492,298 | 1/1985 | Zapletal et al. . | |

FOREIGN PATENT DOCUMENTS

| | | | |
|---|---|---|---|
| 386251 | 1/1933 | United Kingdom | 5/269 |

*Primary Examiner*—David A. Scherbel
*Assistant Examiner*—Richard E. Chilcot, Jr.
*Attorney, Agent, or Firm*—Wood, Herron & Evans

[57] ABSTRACT

A spring assembly for mattresses, innersprings, and the like. The assembly comprises rows of coils, each row comprising a continuous length of wire formed into a plurality of coils interconnected by Z-shaped wire segments alternately disposed at the top and bottom of the coils. Adjacent rows of coils are connected by helical wire wound through overlapping sections of the Z-shaped wire segments. The overlapping connected sections are straight, flat offset sections located on opposite sides of each coil with the center of each overlapped section being located in a common diametral plane of the coil so that complete compression of the coil does not result in the coil being pulled laterally, twisted and distorted.

6 Claims, 5 Drawing Sheets

OFFSET CONTINUOUS ROW COIL SPRING ASSEMBLY

This is a continuation of application Ser. No. 779,869, filed Sept. 25, 1985, now abandoned.

This invention relates to spring assemblies of the type commonly used in the construction of innersprings, mattresses, upholstered furniture, and the like. More particularly, the present invention relates to a spring core assembly in which each of the rows of coils is formed from a single continuous length of wire.

Traditionally, spring assemblies useful for mattresses, innersprings, and the like have employed rows of individual coils interconnected at the top and bottom to form the central core of the assembly. Recently, a spring assembly has been developed which is in many ways superior to an assembly which employs rows of interconnected, individual coils. This new spring assembly utilizes a single continuous wire to form all of the coil springs of a row of coils. Such a construction is illustrated and described in U.S. Pat. Nos. 3,657,749; 3,911,511; and 4,357,097. Spring products made in accordance with the disclosures of the above-identified patents have the advantage over spring products made from individual interconnected coils of using considerably less material or wire to obtain the same degree of firmness and resiliency in an upholstered spring product.

There has been a demand for spring assemblies wherein each row of coils in the assembly is formed from a single continuous length of wire, but wherein the rows of coils are laced together by helical wires passing over straight bar sections or so-called "offset" sections of the interconnected coils, rather than over rounded or radiused sections of the interconnected coils as in the disclosures of the above-identified patents. By interconnecting the rows of coils with helical lacing wires passing over substantially straight offset sections, the coils hinge better than coils which are connected by rounded sections of the coils and therefore do not so easily transmit force from one spring to another. Such offset interconnected springs also have the advantage of being less noisy than coils connected by rounded sections of the springs and of being more easily assembled because there is no need to flatten the rounded section enduring the lacing operation.

It has therefore been an objective of this invention to provide a core spring assembly wherein each of the rows of coils is formed from a single continuous length of wire and wherein the adjacent coils of the rows are interconnected by a helical wire wound over substantially straight offset sections of the coils.

The spring assembly which accomplishes this objective, according to the practice of this invention, comprises a plurality of rows of coils, each row of which is formed from a single strand of wire and wherein adjacent coils within the row are interconnected by Z-shaped wire connector segments alternately disposed at the top and bottom of the coils and wherein adjacent rows of coils are connected by helical wires wound through overlapping, substantially straight, offset sections of the Z-shaped wire connector segments. In order to form these substantially straight offset sections in the Z-shaped connector segments of the rows of coils, the end connector segments of the rows of coils are placed in a die set wherein the arcuate or radiused corner sections of the Z-shaped connector segments are flattened by sequential actuation of a series of incremental dies operative to push excess wire created by the flattening operation into the center section of the Z-shaped wire connector segment. The forcing of the additional wire into the center of the Z-shaped connector segment of the rows of coils, rather than into the barrel of the coils, maintains the parallel alignment of the coils and prevents the coils from being angularly displaced relative to one another by the addition of greater or lesser quantities of wire in one coil relative to another.

The primary advantage of the practice of this invention is that it enables a spring assembly to be manufactured having a plurality of rows of coils, each row of which is made from a single strand of wire and wherein coils of adjacent rows are interconnected by a helical wire wound through substantially straight or flat offset sections of the adjacent coils. By so interconnecting the adjacent coils, the hinging action between adjacent coils is improved and metal noise or squeak associated with flexing of the coils is minimized. Furthermore, the resulting rows of coils may be more easily assembled by threading of the helical wire over the adjacent coils because there is no need to compress or flatten the radius of the coils to facilitate the threading of the helical lacing wire over the coils.

These and other objects and advantages of this invention will be more readily apparent from the following description of the drawings in which.

Figure 1:
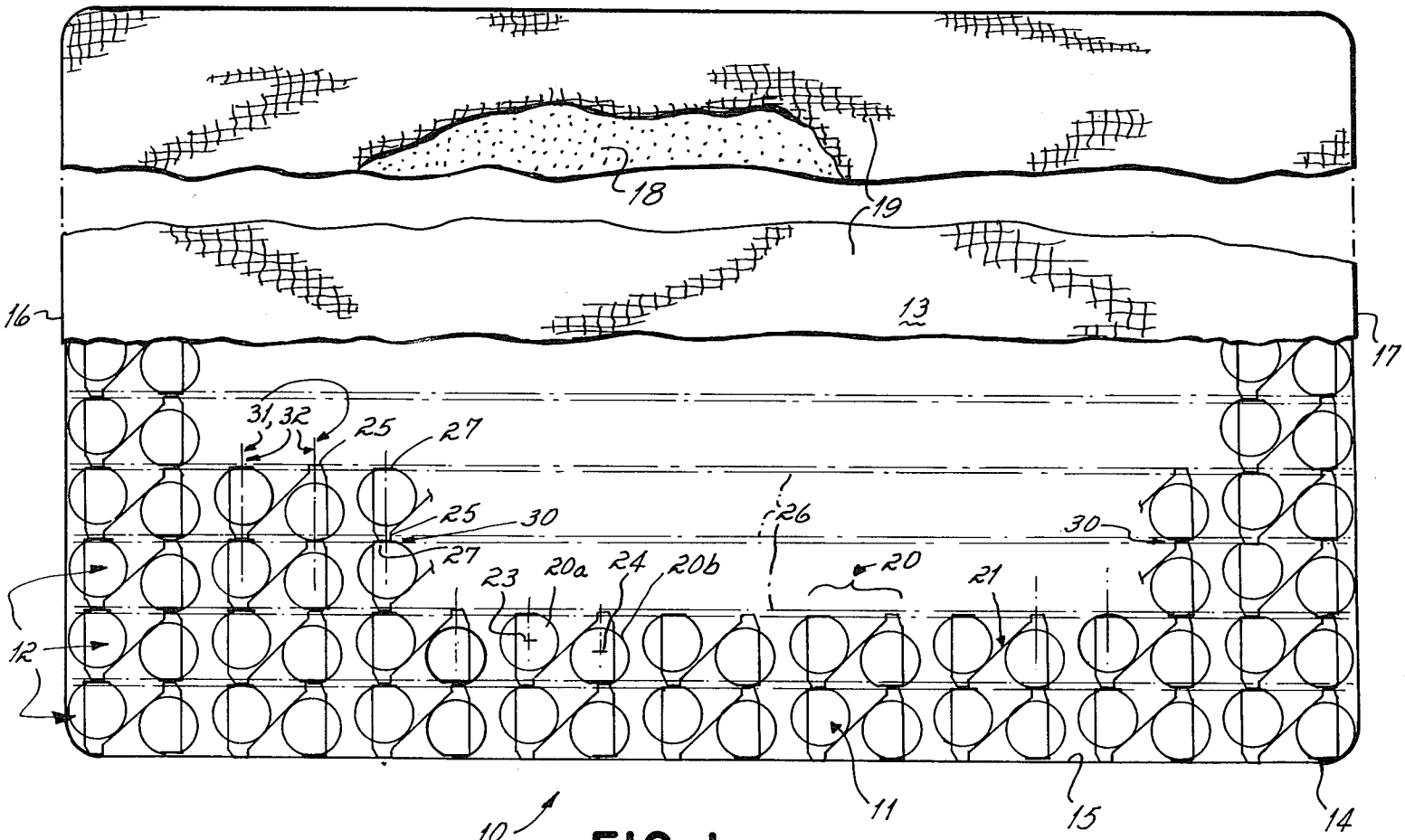
FIG. 1 is a fragmentary top plan view, partially broken away, of a bedding mattress manufactured in accordance with the practice of the invention of this application.

Referring now to the drawings and particularly to FIG. 1, there is shown an innerspring bedding unit or mattress 10 utilizing a spring assembly 11 incorporating novel rows of coils 12 (FIG. 2) made in accordance with the invention of this application. The upper surface 13 of innerspring mattress 10 has a generally rectangular periphery 14 which may be enclosed by a border wire 15. Similarly, the lower surface (not shown) of innerspring mattress 10 has a rectangular periphery which also may be enclosed by a border wire.

Figure 2:
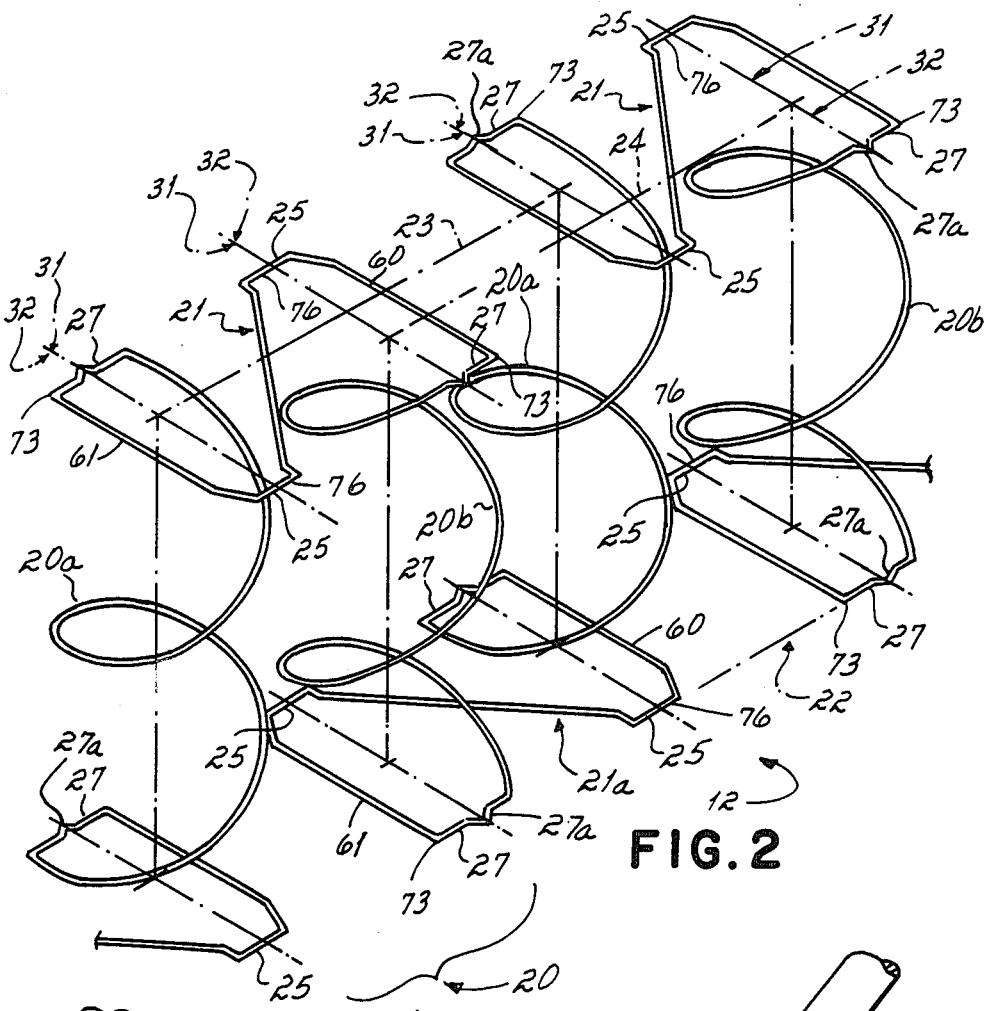
FIG. 2 is a perspective view of a portion of one row of coils utilized in the bedding mattress of FIG. 1.

Innerspring 10 includes a plurality of rows of coils 12 which extend from one side 16 to the other side 17 of the unit. As best illustrated in FIG. 2, each row 12 of coils is formed from a continuous length or strand of wire. The wire is configured to form a plurality of spaced coil pairs 20 interconnected by substantially Z-shaped wire segments 21, 21a disposed sequentially first in the plane of upper innerspring surface 13 and then within the plane of lower innerspring surface 22

(FIG. 2). Each coil pair 20 comprises a first coil 20*a* offset from a second coil 20*b* having the same number of turns. The axes of coils 20*a* lie within a plane 23 which is parallel to, but spaced apart from, a second plane 24 within which lie the axes of offset coils 20*b*. It will be appreciated that the axes of adjacent coils 20*a* and adjacent coils 20*b* are equidistant, the axes being generally perpendicular to the upper and lower surfaces 13 and 22 of the innerspring unit 11.

While each of coils 20*a* and 20*b* is illustrated as having one and one-half full turns or convolutions, this number is not critical. Thus, a greater or lesser number of convolutions may be used, depending upon the tensile strength of the wire and the manner in which the coils are formed so as to provide a spring force appropriate to the particular application.

Each row 12 is configured identical to each adjacent row and each coil within each row 12 is identical to every other coil. The spacing between axes of adjacent coils within row 12 is the same as between axes spacing adjacent coils in adjacent rows.

In order to connect the adjacent rows of coils, the Z-shaped segments 21, 21*a*, which interconnect adjacent pairs of coils within each row, are positioned so that they overlap the Z-shaped segments of the adjacent rows of coils. These overlapped portions or sections 25, 27 of the Z-shaped segments are then tied together by helical wire connector 26. A first set of helical lacing wire connectors is disposed within the plane of upper innerspring surface 13 so as to join together overlapped portions 25, 27 of upper Z-shaped interconnection segments 21. Similarly, a second set of helical lacing wire connectors (not shown) lie within the plane of lower innerspring surface 22 and serve to join together overlapped portions 25, 27 of lower Z-shaped interconnection segment 21*a*. As evident in the plan view of FIG. 1, the length of each helical lacing wire is approximately the same as the length of the rows, and the helical lacing wires 26 extend parallel to the rows.

The assembly of the helical lacing wires to the row of continuous coils may be accomplished on an assembly machine. In such a machine, the upper and lower surfaces of the adjacent rows of coils are positioned so that the sections 25, 27 of the adjacent Z-shaped segments are positioed in overlapping relationship and a helical lacing wire is then rotated or screwed onto the overlapping portions 30 of the Z-shaped segments 21, 21*a*. After completion of the threading of the helical lacing wires onto the Z-shaped segments, the now connected adjacent rows of coils may be indexed forwardly and another pair of upper and lower helical lacing wires threaded over the next row of coils. This process is repeated for the desired length of the mattress, after which the spring assembly is removed from the machine.

Figure 3:
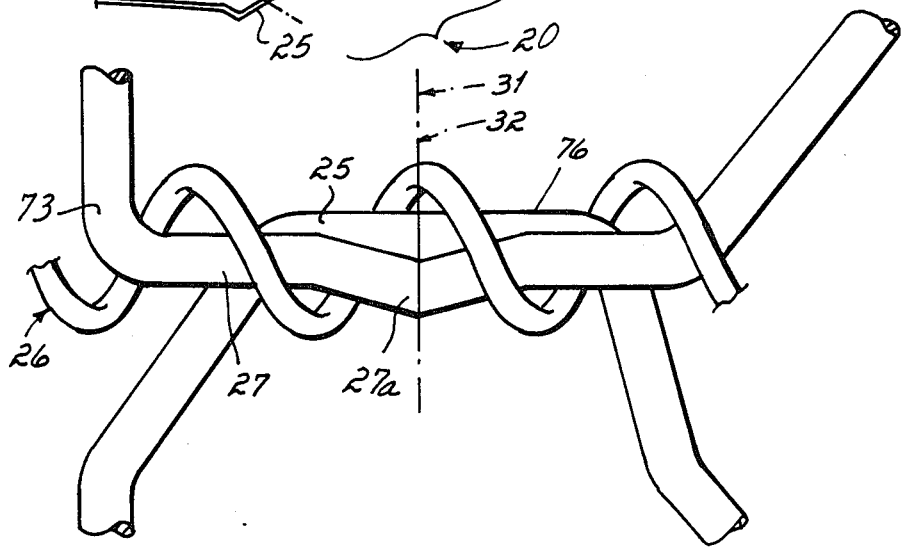
FIG. 3 is an enlarged top plan view of the interconnection of two adjacent rows of coils utilized in the mattress of FIG. 1.

With reference now to FIGS. 2 and 3, it will be seen that the helical lacing wires 26 make approximately three full revolutions in the course of passage over the overlapped portion 27 and two full revolutions over the overlapped portion 25 of the Z-shaped segments. It will also be seen that the overlapped portions or sections 25, 27 of the Z-shaped segments, except for a slight dimple 27*a* in the portion 27, are substantially straight or flat, rather than being rounded or radiused as in prior art U.S. Pat. No. 4,358,097. This straight or flat section of the Z-shaped segments of the connected coils is referred to in the trade as an "offset section." Offsets have been used, as in U.S. Pat. No. 3,648,737, to interconnect individual round coils by means of a helical lacing wire wound over the offset portions of the endmost turns or convolutions of the otherwise round top and bottom turns or convolutions of the coils. The use of substantially flat or straight offsets overlapped portions of the Z-shaped connector enable the locked or interconnected adjacent coils to more freely pivot relative to each other while still being locked or retained against relative longitudinal or lateral movement. Additionally, the use of these substantially flat or straight offset overlapped sections of the Z-shaped connectors facilitates assembly of the rows of coils by means of a helical connector by eliminating the need to partially flatten the rounded overlapped portion during the assembly process.

Figure 16:
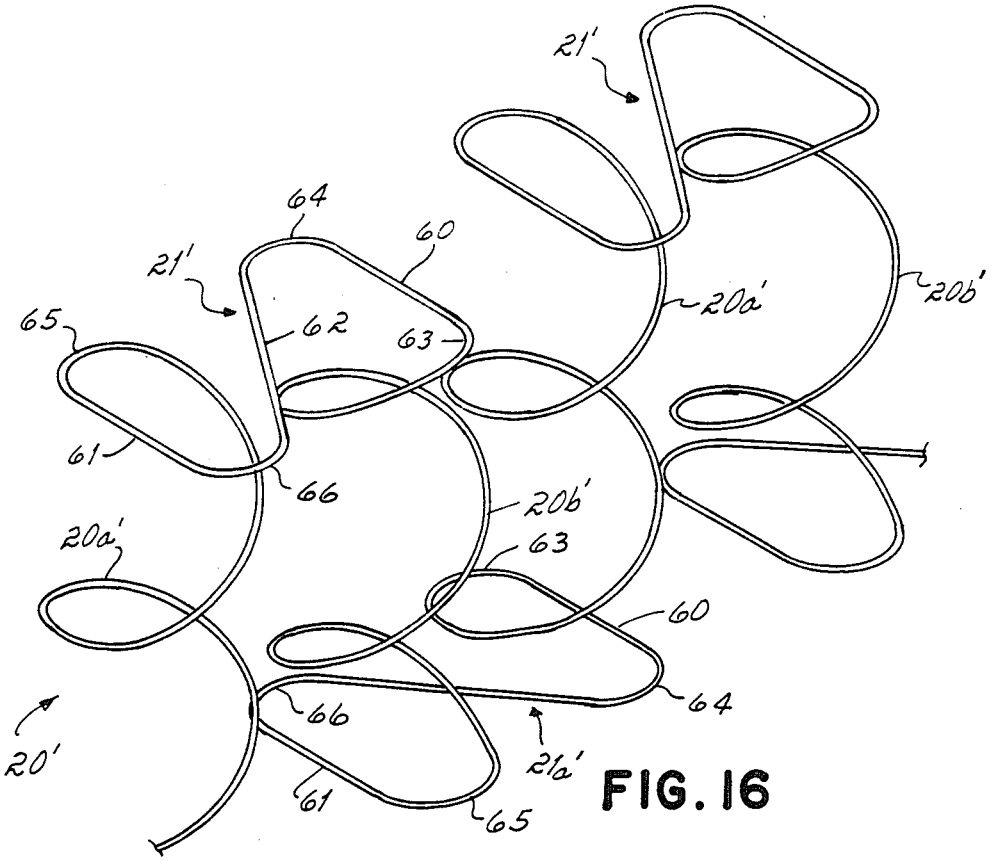
FIG. 16 is a perspective view of a portion of a row of coils prior to the formation of the substantially straight offset sections of the connector segments of the row in the die set of FIGS. 4 through 15.
Figure 17:
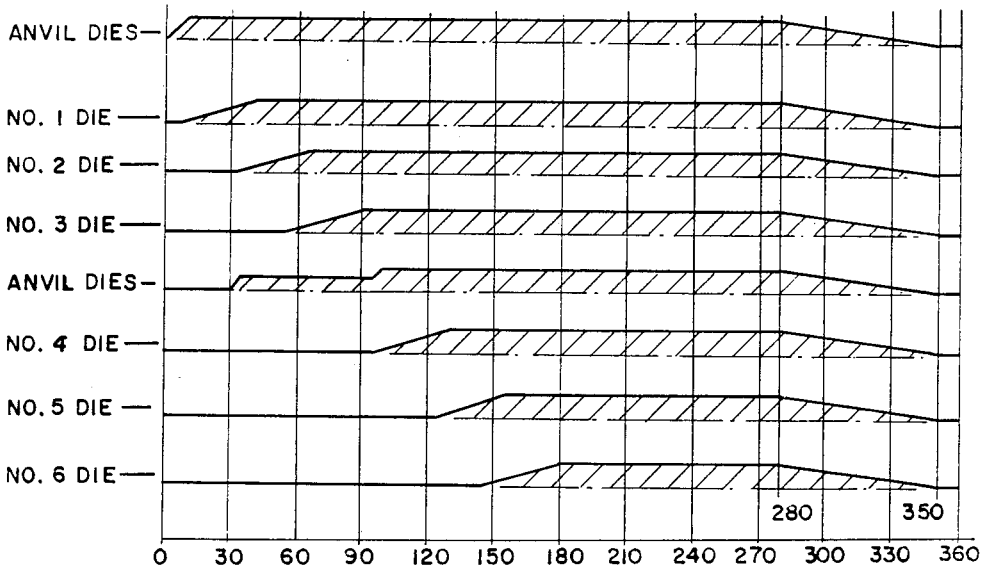
FIG. 17 is a timing chart of the sequential operation of the dies in the die set of FIGS. 4 through 15.

With reference now to FIGS. 4 through 15 there is illustrated the die set 40 and the sequence of forming steps utilized to form the overlapped offset flat portions 25, 27 of the Z-shaped connectors. In FIG. 16 there is illustrated the configuration of one row of coil springs prior to the formation of the flat offsets 25, 27. This is the configuration of the rows of coils generated by the apparatus disclosed in U.S. Pat. No. 4,112,726.

The die set illustrated in FIGS. 4 through 15 is intended to receive one Z-shaped connector section of a row of coil springs and to form the flat offsets 25, 27 therein. This same die set can be used to form both the top and bottom Z-shaped connectors in the row of coils by sequentially forming the flat offsets 25, 27 in first the top and then the bottom Z-shaped connectors, or alternatively, a second die set (not shown) may be mounted above or across from the die set 40 and used to form the flat offsets 25, 27 in the top Z-shaped connector simultaneously with the forming of the flat offsets 25, 27 in the bottom Z-shaped connector.

With reference now to FIGS. 4 through 15, it will be seen that the die set 40 comprises a base plate 41; four anvil dies 42, 43, 44 and 45; and four sets of forming dies 48, 49, 50 and 51. Each set of forming dies 48, 49, 50, and 51 comprises three individual and separately moveable dies. Two of these four sets of forming dies, the sets 48, 50, are mirror images of one another, and similarly, two other sets 49, 51 are mirror images of one another. All of the dies are movably mounted upon the base plate 41. In one preferred embodiment, this movement is effected by rotary cams operating off of a common drive shaft and operable through a series of links to move the dies in accordance with the sequence described hereinbelow. This movement, though, could as well be effected by hydraulic motors or by a number of other mechanisms which could readily be supplied by a person skilled in this art. Therefore, this mechanism has not been illustrated and described in this application.

Figure 4:
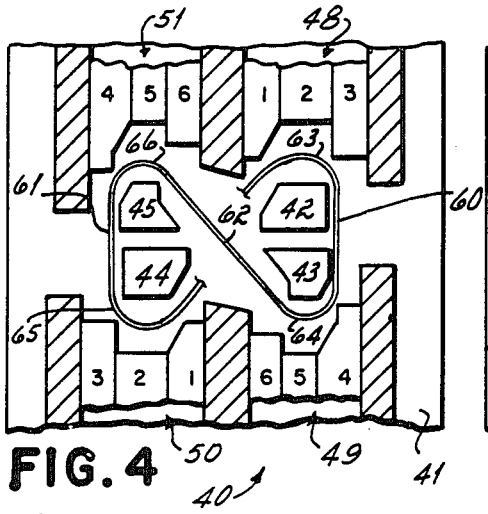
FIGS. 4 through 15 are diagramatic top plan views of a die set utilized in the practice of forming the Z-shaped connector segment of a pair of adjacent coils in a row of coils, illustrating the sequential operation of the die set to form the substantially straight offset sections of a connector segment.

The die set illustrated in FIGS. 4 through 15 is operative to receive one Z-shaped connector segments 21' or 21*a'* (FIG. 16) of a row of coils formed in accordance with the disclosure contained in U.S. Pat. No. 4,358,097. This connector 21' is initially positioned, as illustrated in FIG. 4, with one of the anvil dies 42, 43, 44 and 48 located within each of the four radiused corners 63, 64, 65, and 66 of the connector 21'.

Figure 5:
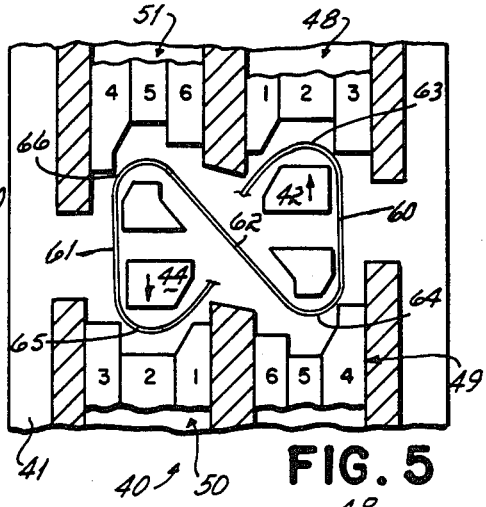
Figure 6:
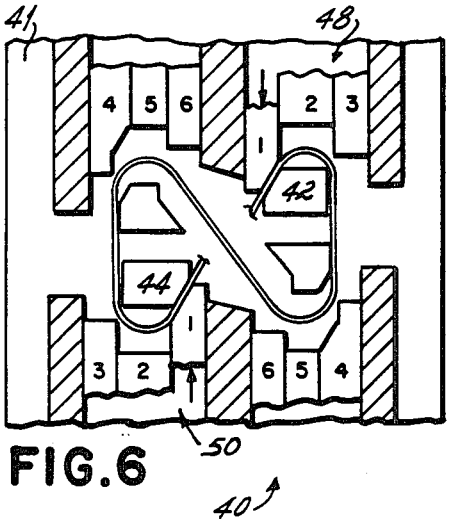
Figure 7:
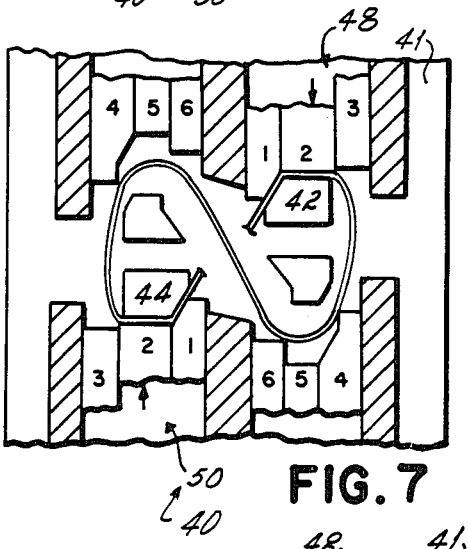
Figure 8:
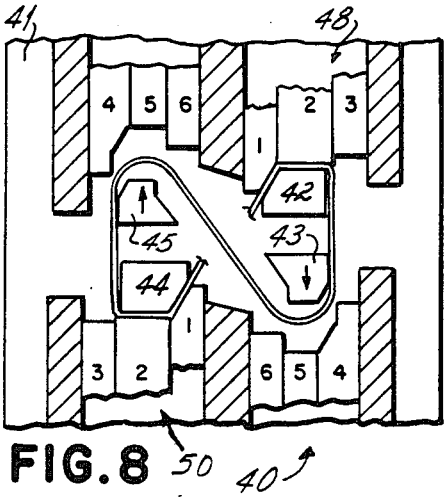
Figure 9:
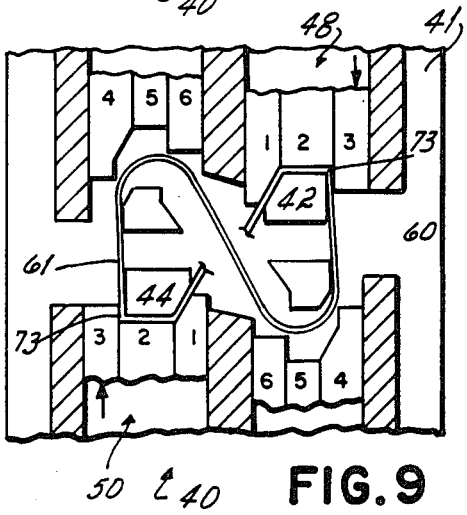

Forming of the flat offsets in this connector 21' is initiated by outwardly movement of the anvil dies 42, 44 as illustrated in FIG. 5. The dies identified as die No. 1 of the forming die sets 48, 50 are then moved inwardly, as illustrated in FIG. 6, so as to clamp a portion of the connector segment 21' against each of the anvil dies 42, 44. As illustrated in FIG. 7, the forming dies designated as die No. 2 of each of the sets 48, 50 are then moved inwardly to form the flats or straight offset sections 27 of the connector. The anvil dies 43, 45 are then moved outwardly, as illustrated in FIG. 7, for approximately one-half of the full stroke or movement of the anvil dies 43, 45 so as to take up the bow created in the side bars 60, 61 of the Z-shaped connector by the dies identified as dies No. 1 and dies No. 2. Dies No. 3 of the forming die sets 48, 50 are then moved inwardly (FIG. 9) so as to form the corners 73 of the offset section 27 of the connector segment and to push all excess metal or wire created by the forming of the offset flats 27 toward the radiused corner sections 64, 68 of the Z-shaped connector segment.

Figure 10:
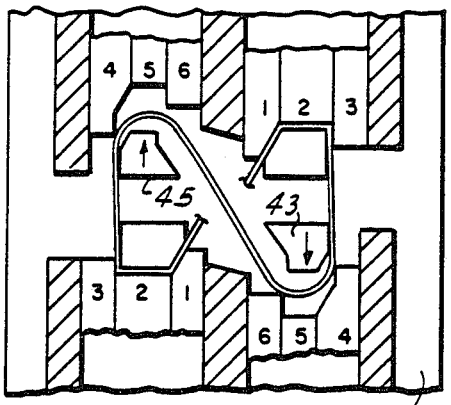
Figure 11:
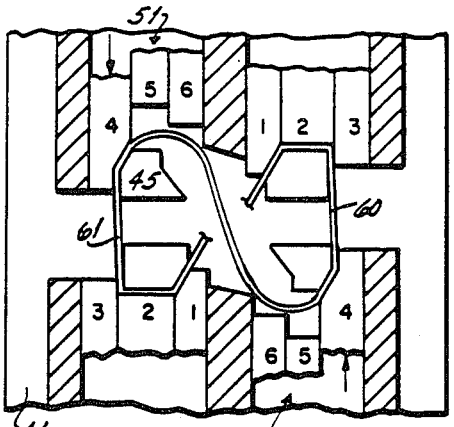
Figure 12:
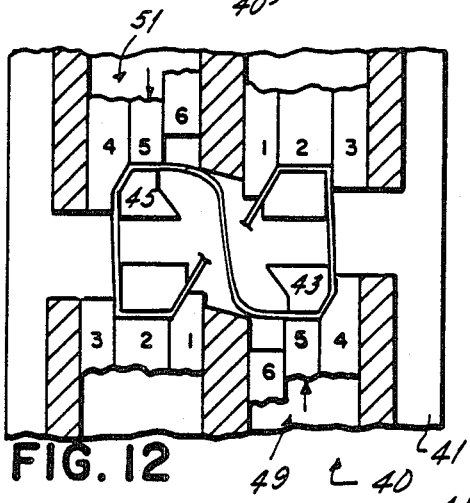
Figure 13:
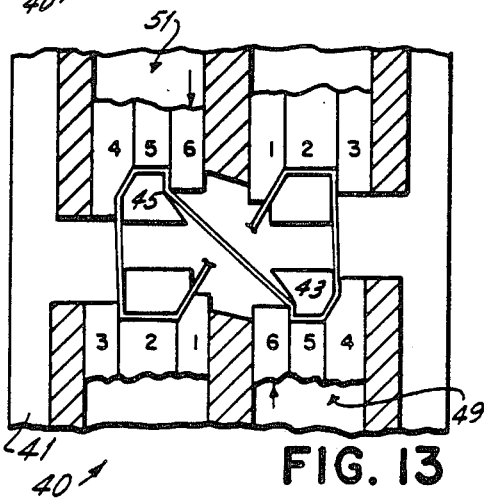
Figure 14:
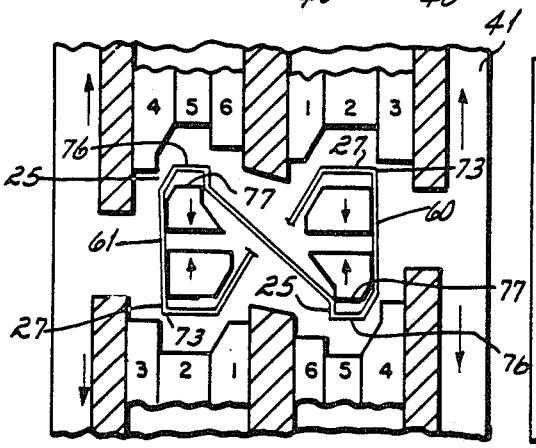
Figure 15:
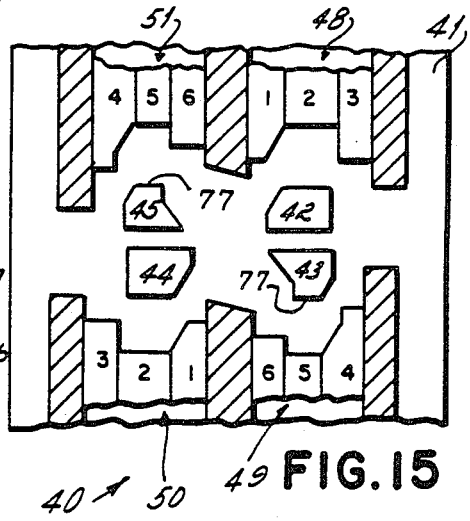

With reference to FIG. 10, it will be seen that the anvil dies 43, 45 are next moved outwardly for the remainder of their full strokes into contact with the radiused corners 64, 66 of the connector segment. The dies designated as die No. 4 of the die sets 49 and 51 are then moved inwardly, as illustrated in FIG. 11, so as to clamp and partially form a radiused corner 64, 66 of the Z-shaped connector between dies No. 4 and anvil dies 43, 45. The dies designated as die No. 5 of the die sets 49 and 51 are next moved inwardly so as to form the flats 76 of the offsets 25 by forcing the wire against the flat surface 77 of the anvil dies 43, 45 (FIG. 12). The dies designated as die No. 6 are next moved inwardly, as illustrated in FIG. 13, so as to force all of the excess wire, which had been generated by the forming of the flat offsets 25, into the crossbar or diagonal section 62 of the Z connector 21. As a consequence of these die movements, the head or Z connector 21 is now completely formed and ready for withdrawal of the formed head from the die set 40. This is accomplished (FIG. 14) by moving all of the forming die sets 48, 49, 50 and 51 outwardly and the anvil dies 42, 43, 44, and 45 inwardly. The formed head may then be lifted from the die set, and the die set (FIG. 15) is ready for the insertion of a new Z-shaped connector 21' preparatory to recycling of the die set.

With reference now to FIG. 16, there is illustrated a sequencing chart of the dies when the sequencing is controlled by a rotary cam which rotates one full revolution during the complete sequencing of the die set.

The sequencing of the incremental die set 40 is dictated by the need to displace all of the excess wire created by the forming of the offsets 25, 27 into the center crossbar or diagonal bar 62 of the Z-shaped connecting segment of the spring. If that excess wire were not displaced into the diagonal bar 62, it would necessarily have to be displaced into one or the other, or both, of the barrels or coils 20 of the coil springs to which the Z-shaped connecting section of the springs is attached. If this excess wire were so displaced into the barrel of these coils, it would result in differential lengths or differential angulation of the coils, which would in turn result in a skewed or crooked spring assembly and difficulty in assembly the rows of coils into the complete mattress.

Referring now to FIGS. 1 and 3, it will be noted that the center of the several rotations of the helical wires 26, which pass around the overlapped offset sections 25, 27 of the coils, are all located in a diametral plane 31 of the coils 20. It will further be noted that this diametral plane 31 passes through the center 32 of the offsets 25, 27 on opposite sides of each coil. Consequently, each coil, except for the outermost coils around the periphery of the assembly, is connected to two coils of the adjacent rows of coils by offset connectors, the centers 32 of which are located in a common diametral plane 31 of the coil. This location of the axes of the coils relative to the locations of the overlapped and connected offsets 25, 27 of the Z-shaped connecting segments 21 is important to the practice of this invention. Specifically, it has been found that when the connections between the coils of adjacent rows are not so located relative to the axis of the coils, the coils, upon compression, deflect laterally and become distorted.

After the Z-shaped connecting segments or connectors of all of the rows of coils have had the offsets 25, 27 formed therein by the die set 40, the rows of coils are placed in an assembly machine and assembled by having the helical lacing wires 26 applied thereto over the offset sections 25, 27 of the Z-shaped connectors. A border wire 15 may then be attached to the assembled rows of coils by conventional attachment means. A conventional padding 18 is then placed over the tops and bottoms of the spring assembly and the complete assembly, including the pads 18, is enclosed in a fabric cover 19.

While we have described only a single preferred embodiment of our invention, persons skilled in the arts to which this invention pertains will appreciate changes and modifications which may be made without departing from the spirit of our invention. Therefore, we do not intend to be limited except by the scope of the following appended claims.

Having described our invention, we claim:

1. A bedding spring mattress product comprising:

a spring assembly, said spring assembly having upper and lower planar surfaces, said spring assembly including a plurality of rows of coils, each of said rows of coils being formed from a single continuous strand of wire and each of said rows containing a plurality of coils interconnected by Z-shaped interconnecting segments, each of said Z-shaped interconnecting segments comprising a pair of parallel end bars connected by a diagonal bar, alternate ones of said Z-shaped interconnecting segments being disposed in the planes of the upper and lower surfaces of said spring assembly, the axes of said coils being disposed perpendicular to the upper and lower surfaces of said spring assembly, sections of each of said Z-shaped interconnecting segments of each row being overlapped relative to Z-shaped interconnecting segments of an adjacent row, said overlapped sections being located on opposite sides of said coils, helical spring means would through said overlapped sections of said Z-shaped interconnecting segments so as to secure said rows of coils in an assembled relation, the centers of said overlapped sections of said Z-shaped interconnecting segments being located in a diametral plane of said coils, and the center of said substantially straight overlapped offset sections on opposite sides of each of said coils being located in the same diametral plane so that compression of said assembled coils does not cause the axes of said coils to be moved laterally or the coils to be twisted when compressed, a sheet of padding located over said spring assembly in said planes of said upper and lower surfaces of said spring assembly, an upholstered covering surrounding and encasing said spring assembly and said sheets of padding, the improvement wherein all of said overlapped sections of said Z-shaped interconnecting segments are substantially straight sections of wire formed by flattending previously formed arcuate sections of said Z-shaped interconnecting segments, and said diagonal bar of said Z-shaped interconnecting segments being connected to straight sections at opposite ends thereof by offsets formed in said diagonal bar, said offsets serving to take up excess slack wire created during the flattening of said straight sections and to thereby prevent angular displacement of the coils located at opposite ends of said diagonal bar.

2. A spring assembly having upper and lower planar surfaces, said assembly comprising:

a plurality of rows of coils, each of said rows being formed from a single continuous strand of wire and each of said rows containing a plurality of coils interconnected by Z-shaped interconnecting segments, each of said Z-shaped interconnecting segments comprising a pair of parallel end bars connected by a diagonal bar, alternate ones of said Z-shaped interconnecting segments being disposed in the planes of the upper and lower surfaces of said spring assembly, the axes of said coils being disposed perpendicular to the upper and lower surfaces of said spring assembly, sections of each of said Z-shaped interconnecting segments of each row being overlapped relative to a Z-shaped interconnecting segments of an adjacent row, said overlapped sections being located on opposite sides of said coils, helical spring means wound through said overlapped sections of said Z-shaped interconnecting segments so as to secure said rows of coils in an assembled relation, the center of said overlapped sections being located in a diametral plane of said coils, and the centers of said overlapped sections on opposite sides of each of said coils being located in the same diametral plan so that compression of said assembled coils does not cause the axes of said coils to be moved laterally or the coils to be twisted when compressed, the improvement wherein all of said overlapped sections of said Z-shaped interconnecting segments are substantially straight sections of wire formed by flattening previously formed arcuate sections of said Z-shaped interconnecting segments, and said diagonal bar of said Z-shaped interconnecting segments being connected to straight sections at opposite ends thereof by offsets formed in said diagonal bar, and offsets serving to take up excess slack wire created during the flattening of said straight sections and to thereby prevent angular displacement of the coils located at opposite ends of said diagonal bar.

3. A spring assembly, said spring assembly having upper and lower planar surfaces, said spring assembly including a plurality of rows of coils, each of said rows of coils being formed from a single continuous strand of wire and each of said rows containing a plurality of coils interconnected by Z-shaped interconnecting segments, each of said z-shaped interconnecting segments comprising a pair of parallel end bars connected by a diagonal bar, alternate ones of said Z-shaped interconnecting segments being disposed in the planes of the upper and lower surfaces of said spring assembly, the axes of said coils being disposed perpendicular to the upper and lower surfaces of said spring assembly, said parallel end bars of each of said Z-shaped interconnecting segments of each row being overlapped relative to parallel end bars of Z-shaped interconnecting segments of an adjacent row, helical spring means wound over said overlapped parallel end bars of said Z-shaped interconnecting segments so as to secure said rows of coils in an assembled relation, the improvement wherein all of said overlapped parallel end bars of said Z-shaped interconnecting segments are substantially straight sections of wire formed by flattening previously formed arcuate sections of said Z-shaped interconnecting segments, and one of said diagonal bar and said straight sections having offsets formed therein, said offsets serving to take up excess slack wire created during the flattening of said straight sections of wire and to thereby prevent angular displacment of the coils located at opposite ends of said diagonal bar.

4. A spring assembly having upper and lower planar surfaces, said assembly comprising:

a plurality of rows of coils, each of said rows being formed from a single continuous strand of wire and each of said rows containing a plurality of coils interconnected by Z-shaped interconnecting segments, each of said Z-shaped interconnecting segments comprising a pair of parallel end bars connected by a diagonal bar, alternate ones of said Z-shaped interconnecting segments being disposed in the planes of the upper and lower surfaces of said spring assembly, the axes of said coils being disposed perpendicular to the upper and lower surfaces of said spring assembly, said parallel end bars of each of said Z-shaped interconnecting segments of each row being overlapped relative to parallel end bars of Z-shaped interconnecting segments of an adjacent row, helical spring means wound over said overlapped parallel end bars of said Z-shaped interconnecting segments so as to secure said rows of coils in an assembled relation, the improvement wherein all of said overlapped parallel end bars of said Z-shaped interconnecting segments are substantially straight sections of wire formed by flattening previously formed arcuate sections of said Z-shaped interconnecting segments, and said diagonal bar of said Z-shaped interconnecting segments being connected to said parallel end bars at opposite ends thereof by offsets formed in said diagonal bar, said offsets serving to take up excess slack wire created during the flattening of said straight sections of wire and to thereby prevent angular displacement of the coils located at opposite ends of said diagonal bar.

5. A spring assembly having upper and lower planar surfaces, said spring assembly including a plurality of rows of coils, each of said rows of coils being formed from a single continuous strand of wire and each of said rows containing a plurality of coils interconnected by interconnecting segments, each of said interconnecting segment comprising a pair of parallel end bars connected by a connecting bar, alternate ones of said interconnecting segments being disposed in the planes of the upper and lower surfaces of said spring assembly, the axes of said coils being disposed perpendicular to the upper and lower surfaces of said spring assembly, each of said interconnecting segments having a pair of substantially straight sections, said pair of substantially straight sections having offset portions, and said offset portions of each of said interconnecting segments of each row being overlapped relative to straight sections of interconnecting segments of an adjacent row, said overlapped interconnecting segments being located on opposite sides of said coils, and helical spring means wound through said overalpped interconnecting segments so as to secure said rows of coils in an assembled relation.

6. A spring assembly having upper and lower planar surfaces, said assembly comprising:

a plurality of rows of coils, each of said rows being formed from a single continuous strand of wire and each of said rows containing a plurality of coils interconnected by planar interconnecting segments, each of said interconnecting segments comprising a pair of parallel end bars connected by a connecting bar, alternate ones of said planar interconnecting segments being disposed in the planes of the upper and lower surfaces of said spring assembly, the axes of said coils being disposed perpendicular to the upper and lower surfaces of said spring assembly, each of said interconnecting segments having a pair of substantially straight sections, said pair of substantially straight sections having offset portions, and said offset portions of each of said planar interconnecting segments of each row being overlapped relative to substantially straight sections of interconnecting segments of an adjacent row, said overlapped interconnecting segments being located on opposite sides of said coils, and helical spring means wound through said overlapped interconnecting segments so as to secure said rows of coils in an assembled relation.

* * * * *